US005660432A

United States Patent [19]

Davis

[11] Patent Number: 5,660,432

[45] Date of Patent: Aug. 26, 1997

[54] HIGH CHAIR CATCH ATTACHMENT

[76] Inventor: Richard H. Davis, 1155 Churchill Downs Rd., Atlanta, Ga. 30319

[21] Appl. No.: 598,553

[22] Filed: Feb. 8, 1996

[51] Int. Cl.[6] ..... A47D 15/00

[52] U.S. Cl. ..... 297/182; 297/135; 297/188.2

[58] Field of Search ..... 297/135, 144, 297/170, 182, 188.11, 188.12, 188.2, 423.4; 108/24, 26, 152

[56] References Cited

U.S. PATENT DOCUMENTS

| | | | |
|---|---|---|---|
| 837,570 | 12/1906 | Jackson et al. . | |
| 924,554 | 6/1909 | Jackson et al. . | |
| 939,841 | 11/1909 | Jackson et al. | 297/182 |
| 2,540,685 | 2/1951 | Mayer . | |
| 2,585,434 | 2/1952 | Caponera . | |
| 2,938,574 | 5/1960 | Brown . | |
| 2,982,344 | 5/1961 | Berlin | 297/188.12 |
| 3,298,736 | 1/1967 | Decker | 297/182 |
| 3,367,714 | 2/1968 | Stone | 297/188.2 X |
| 4,061,395 | 12/1977 | Boole | 297/188.11 |
| 4,136,907 | 1/1979 | Hermanns | 297/182 |
| 4,165,123 | 8/1979 | Hutson | 297/182 |
| 5,524,957 | 6/1996 | Gibriano | 297/144 |

FOREIGN PATENT DOCUMENTS

| | | | |
|---|---|---|---|
| 204170 | 9/1920 | Canada | 297/170 |

*Primary Examiner*—Peter R. Crown
*Attorney, Agent, or Firm*—Bernstein & Associates

[57] ABSTRACT

A high chair catch tray attachment comprising a generally rectangular tray is selectively engageable with a child's high chair and supported thereby to provide a catch surface to catch and support objects, food and utensils dropped by the child occupying the high chair. The catch tray is adjustably postionable and supported by the high chair legs so that the catch tray surface may be maintained at a height that supports objects and food falling on and supported by the catch tray out of reach of the child occupying the high chair.

6 Claims, 5 Drawing Sheets

HIGH CHAIR CATCH ATTACHMENT

TECHNICAL FIELD

The present invention relates to an attachment for a child's high chair and, more particularly, to a catch attachment, attached to and supported by the high chair, for catching food, liquid and other material or articles dropped by the child occupying the high chair to protect the floor adjacent and surrounding the high chair.

BACKGROUND OF THE INVENTION

For years, parents of children of toddler age have had to deal with the problem of feeding their children and, at the same time, keeping some degree of orderliness in the area while doing so. Children of the toddler age are often seated in a high chair and then fed by the parent or are allowed to feed themselves from a plate of food placed on a table tray attached to high chair. Parents desiring to train their children to feed themselves watch, without interfering, as the child awkwardly picks up the food and places it in its mouth. Unfortunately, not all the food is placed in the child's mouth, much of the food being dropped by the child over the edge of the tray table and landing on the floor. At some point in the child's development, parents will provide the child with utensils such as a spoon, a fork or a cup to continue the eating training. These utensils also find their way to the floor surrounding the high chair, soiling the floor and the utensil.

Many devices directed at preventing or lessening the mess created by dropped food and utensils are available in the prior art. These devices include trough-like shields, attached to the high chair, which extend from the rear extreme of the arm rest and around the table tray. While these trough like devices are effective to prevent food and utensils from dropping to the floor, they are difficult to adapt to the variety of high chairs available and are difficult to clean owing to their size and shape, and placement to other chairs at the table. They may also interfere with the proper functioning of the table tray which otherwise is easily unclipped and removed from the high chair. Additionally, food and/or utensils dropped by the child into the troughs typically remain within reach of the child such that the child is free to retrieve the food and/or utensils and cause further mess. Also, a high chair adapted with these devices takes on a greater peripheral dimension making the high chair cumbersome to move and to store. These devices also tend to interfere with the child's movement because of the placement of the device near the child's feet and legs.

Another device commonly used to protect the floor area adjacent the high chair is a flexible sheet that is placed directly on the floor and upon which the high chair is placed. These devices typical comprise a rectangularly shaped vinyl film. It may be clear or opaque and may be provided with decorative figures to make it more attractive. Food or utensils dropped by the child fails to the sheet. The sheet is effective to protect the floor from being soiled and prevents the utensil from becoming soiled. However, these devices tend to be difficult to clean because of their size and flexibility and do not move with the high chair when the high chair is moved to a different location and still force an adult down on their knees to clean the floor.

What is needed and what is not available is a food catch tray adapted for use with a high chair to protect the surrounding floor area from being soiled by food and utensils dropped by a child placed in and eating from the high chair. Furthermore, there is a need for a catch tray device that is easy to clean and that can be easily and conveniently stored.

The device should be light in weight and easily maneuvered and positioned by a parent or caregiver so that material or things dropped on the catch tray do not remain within the child's reach. The needed catch tray should be mechanically simple and durable, safe to operate and preferably capable of being folded up and out of the way while still remaining attached to the high chair.

SUMMARY OF THE INVENTION

The present invention solves the above described problems in the prior art by providing a high chair catch attachment which is useful for catching dropped food and other articles to prevent the surrounding floor area from becoming soiled.

More particularly described, the apparatus of the present invention includes a rigid catch tray which is held in adjustable engagement with the high chair by a catch tray attaching means. The catch tray defines an upwardly facing catch surface which is most desirably positionable in a generally horizontal plane.

The catch tray attaching means allows the catch tray to be selectively and adjustably attached to high chairs having a variety of structural configurations. The attaching means desirably allows the catch tray to be easily attached to and removed from the high chair. In the preferred embodiment of the present invention the attaching means allows the catch tray to be adjusted relative to the high chair and the seated child's reach. Also, in one embodiment of the present invention, the attaching means preferably allows the catch tray to be placed in a folded, generally vertical position so that the catch tray may remain in engagement with the high chair in an unobtrusive manner when not in use.

In the preferred embodiment the catch device includes a pair of catch trays supported on the left and right sides of the high chair so that food and/or articles dropped on either side of the high chair are caught by the catch trays.

Therefore, it is an object of the present invention to provide a device for catching food and articles dropped by a child occupying a high chair.

It is further object of the present invention to provide a catch device that is adaptable to a variety of high chair structural configurations.

It is still a further object of the present invention to provide a catch device that is easily cleaned and is selectively adjustable into a storage position such that it is unobtrusive when not in use.

It is a another object of the present invention to provide a catch device that does not interfere with the movement of the feet or legs of a child sitting in the high chair and will allow other chairs to be placed on either side.

It is still a further object of the present invention to provide a food catch tray that is capable of being positioned at various positions relative to the high chair and the child's reach.

Other objects, advantages and features of the present invention will be more readily understood from the following detailed description of specific embodiments thereof when read in conjunction with the accompanying drawings.

DETAILED DESCRIPTION

Figure 1:
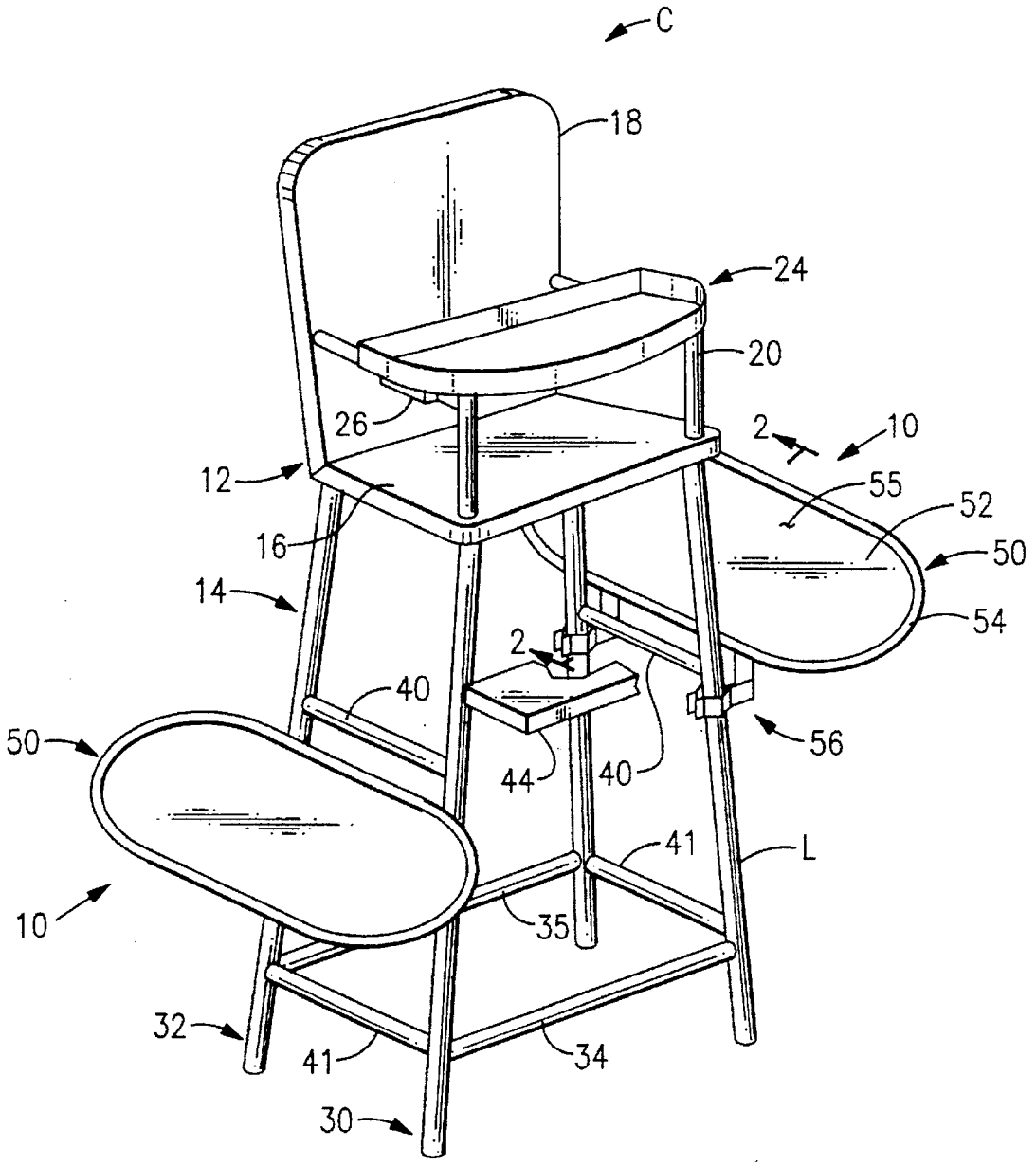
FIG. 1 is a pictorial view of a first embodiment of the catch tray of the present invention attached to the upwardly extending high chair legs of a child's high chair.

FIG. 1 shows a child's high chair C with a pair of catch tray assemblies 10, according to a first preferred embodiment of the present invention, supported on opposed left and right sides of the chair C.

The chair C comprises a seat structure 12 supported by a support structure 14. The seat structure 12 comprises a seat 16 and a back 18, the seat 16 and back 18 disposed at an angle to one another. A pair of L shaped arms 20 are attached to the seat 16 and the back 18 in a well known manner. The arms 20 support a tray table 24 which is securely yet removably selectively engaged with the arms 20 by table latches 26 operatively interconnected between the tray table 24 and the arms 20.

The support structure 14 comprises pairs of front and rear legs 30 and 32, respectively, secured to the seat 16. The left legs of front and rear pair of legs, 30 and 32, are supported against movement relative to the right legs of front and rear pairs of legs, 30 and 32, by front and rear leg rungs 34 and 35. Similarly, the front legs 30 are supported against movement relative to the rear legs 32 by pairs of upper side rungs 40 and lower side rungs 41. A foot support 44 is attached to, and is supported by, the front legs 30 substantially perpendicular thereto.

Figure 2:
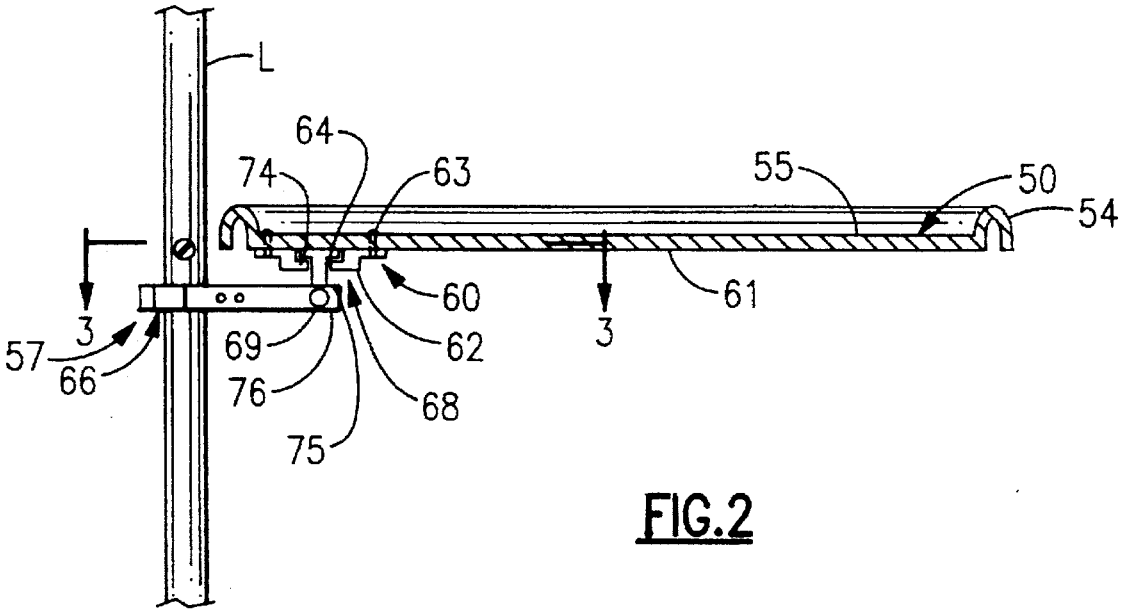
FIG. 2 is a cross-sectional side view of the catch tray shown in FIG. 1 taken along line 2—2.
Figure 3:
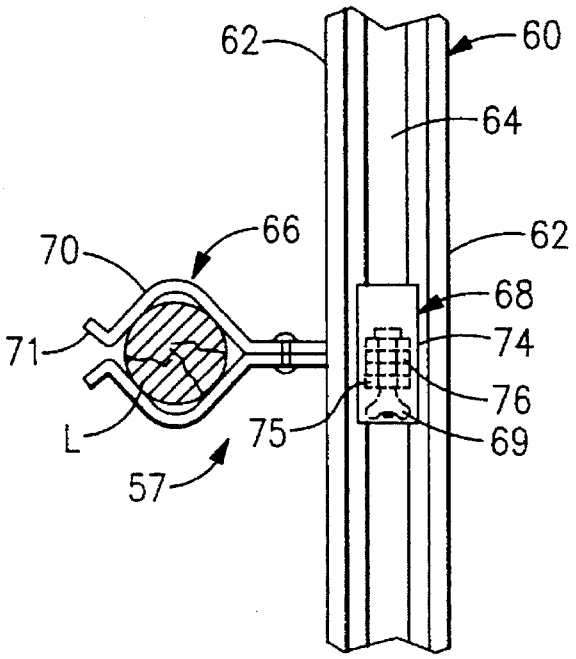
FIG. 3 is a top perspective view, shown in partial cross section of the attaching means of the catch tray shown in FIG. 2 taken along line 3—3.
Figure 4:
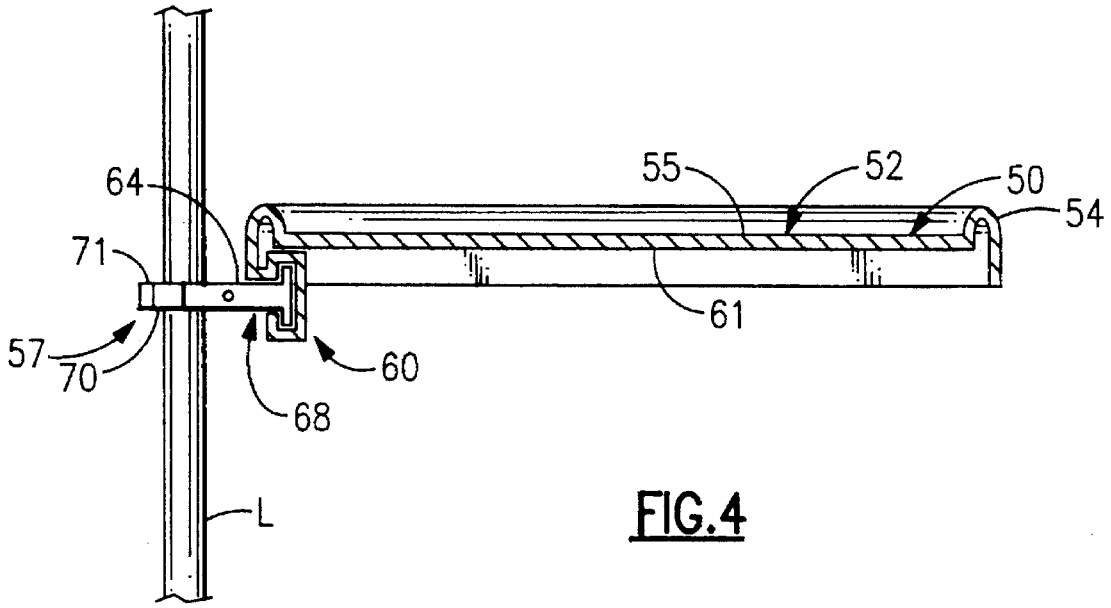
FIG. 4 is an alternative embodiment of the attaching means adapted to the catch tray shown in FIG. 1.

Each of the catch tray assemblies 10 comprises a catch tray 50 attached to and supported by the support structure 14 through an attaching means 56, alternatives of which are shown most clearly in FIGS. 2–4. The catch tray 50 is shown to be generally oblong with parallel side edges and rounded ends. It is to be understood that the shape depicted in the several drawings is not to be taken as a limitation of the present invention and that other shapes of the catch tray 50 are within the contemplation of the present invention.

The catch tray 50 includes a planar tray body 52 having a raised lip 54 extending from the tray body 52 and peripherally disposed about its outer edge. The planar tray body 52 defines an upper catch surface 55 which is supported substantially horizontally when the catch tray assembly 10 is attached to the high chair C.

The catch tray 50 is preferably fabricated of a plastic material, however, other materials, including metal, such as aluminum or stainless steel, could be used. It is desirable that the catch tray 50 be fabricated of a material that will not stain and is easily cleaned. The catch tray 50 may be made of a clear material, such as acrylic, or it may be opaque. Preferably the material will withstand the effect of ordinary household cleaners and could be fabricated of material suitable for use in a dishwasher so that the catch tray 50 can be inserted into a dishwasher for cleaning.

The width of the catch tray 50 is sized so that the catch surface 55 extends about a foot or more to the left and right of the chair C. The length of the catch tray 50 is sized so that the catch surface 55 extends in front of and rearwardly of the front and rear legs, 30 and 32, respectively, about six to twelve inches. It is to be understood that any practical size of the catch tray 50 is within the contemplation of the present invention.

Two alternative attaching means 56 are shown in FIGS. 2–4. In FIGS. 2 and 3, the attaching means 56 includes spring clamp assemblies 57 attached to a portion of a leg L and operatively interconnected with the catch tray 50 by a T-slot assembly 60 that extends along a lower surface 61 of the catch tray 50 opposite the catch surface 55.

The T-slot assembly 60 comprises opposed Z-shaped bars 62, secured to the lower surface 61 by conventional means including rivets 63, thereby providing a T-slot 64 defined between the bars 62. Other means for securing the bars 62 to the catch tray 50 are well known in the art and adaptable to the present invention. Also, the T-slot 64 may be provided by other means such as by integrally molding the T-slot 64 into the catch tray body 52 in a well known manner.

The spring clamp assembly 57, includes a leg clamp 66 and a T-slider 68 pivotally engaging the leg clamp 66 through a screw clamp 69. The leg clamp 66 comprises opposed spring steel clamping members 70. The spring clamping members 70 are bent to provide a generally circular clamping region and divergent leg engaging ears 71. The nominal, un-sprung, diameter of the clamping region, that is when the spring clamp assembly 57 is not attached to the high chair leg L, is smaller than the anticipated diameter of the high chair leg L to which the spring clamp assembly 57 will be engaged.

The T-slider 68 comprises a plate 74 sized to slide freely but remain captive within the T-slot 64. An engaging flange 75 extends downwardly from the plate 74 outwardly of the opposed bars 62. An end of the flange 75 opposite the plate 74 is pivotally engaged with ends 76 of the clamping members 70, opposite the leg engaging ears 71, by the screw clamp 69 which engages cooperating apertures defined in the flange 75 and the clamping members 70.

The spring clamp assemblies 57 are free to slide in the slot 64 of the T-slot assembly 60. This allows the spacing between the spring clamping assemblies 57, two of which are provided for each catch tray assembly 10, to accommodate the variable spacing between the high chair legs 30 and 32 as the height of the catch tray 10 is selectively adjusted along the legs. The legs of a typical high chair are typically angularly displaced from the vertical which causes the spacing between the legs to vary from the floor to the seat 16. Also, the spacing of the legs 30 and 32 between different manufacturers will most likely vary.

The pivotal interconnection of the flange 75 with the clamping member 70 allows the catch tray 50 to be positioned in a horizontal plane even though the legs 30 and 32 are angled from the vertical on most high chairs.

The leg clamp 66 is attached to the high chair leg 30 or 32 by first adjusting the spacing between the leg clamps 66 and then engaging the leg engaging ears 71 against the leg at generally the desired height on the leg 30 or 32. The spring clamp 66 is pushed toward the leg 30 or 32 thereby urging the leg engaging ears 71 and the clamping members 70 apart such that the spring clamp is disposed about the leg 30 or 32 with the leg positioned within the circular clamping region. In this position the clamping members 70 are disposed in compressive engagement with the legs due to the spring tension of the material used to fabricate the clamping members 70, which is preferable a high tempered steel. The catch tray 50 is then positioned manually generally horizontally and locked by the screw clamp 69.

An alternative embodiment of the catch tray 50 and clamp assembly 57 is shown in FIG. 4. The clamp assembly 57 is disposed in adjustable engagement with the T-slot 64 of the T-slot assembly 60 which is adapted to and extends along a vertical side edge of the catch tray 50. In FIG. 4 it will be seen that the clamp assembly 57 is a rigid clamp assembly and provides for no pivotal adjustment of the catch tray 50. However, the clamp assembly 57 could be provided with a leg clamp 66 and a T-slider 68, similar to that shown in FIGS. 2 and 3, and as described above, thus providing pivotal adjustment of the catch tray 50.

Figure 5:
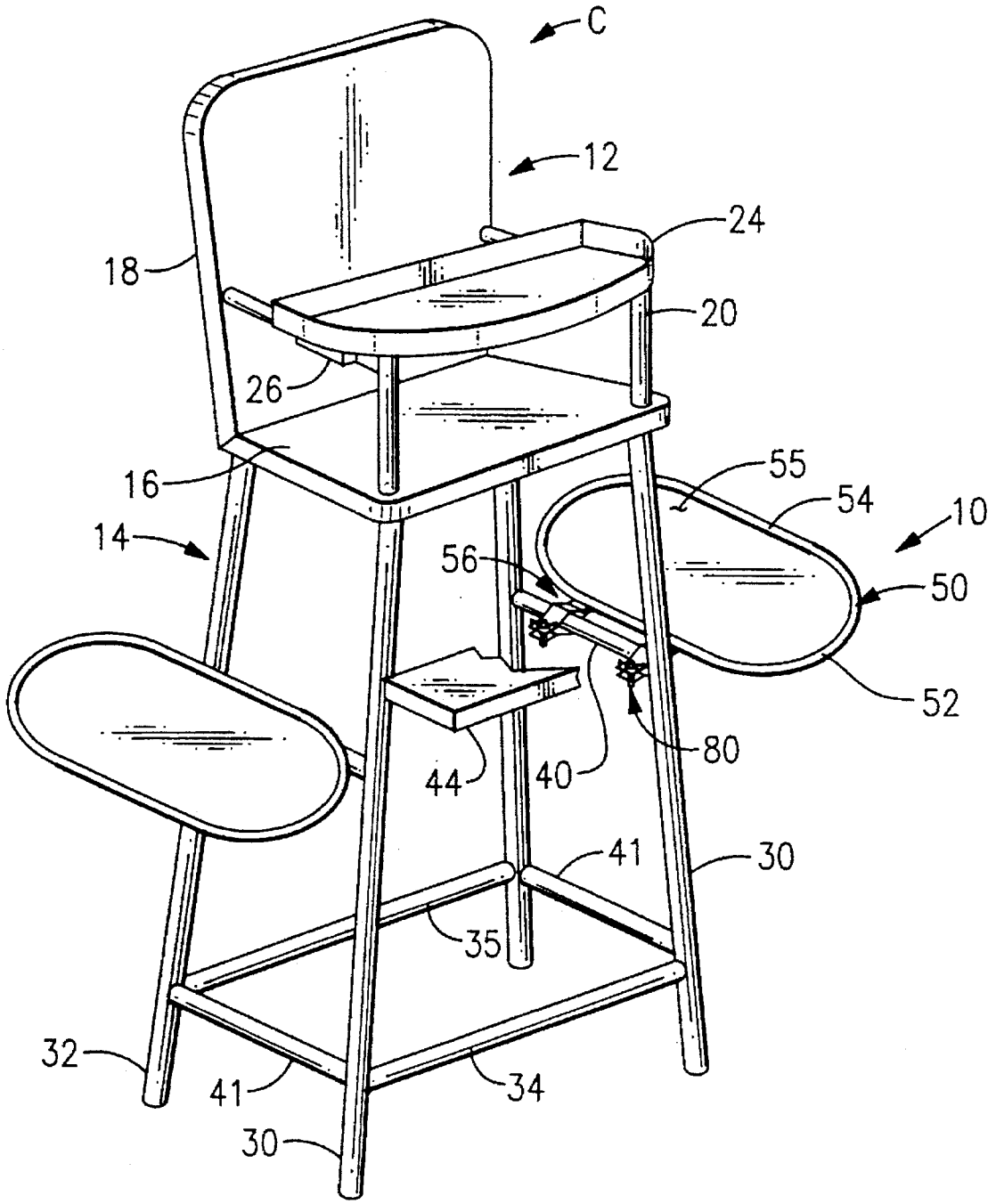
FIG. 5 is a pictorial view of a second embodiment of the catch tray of the present invention attached to the rungs of a child's high chair.
Figure 6:
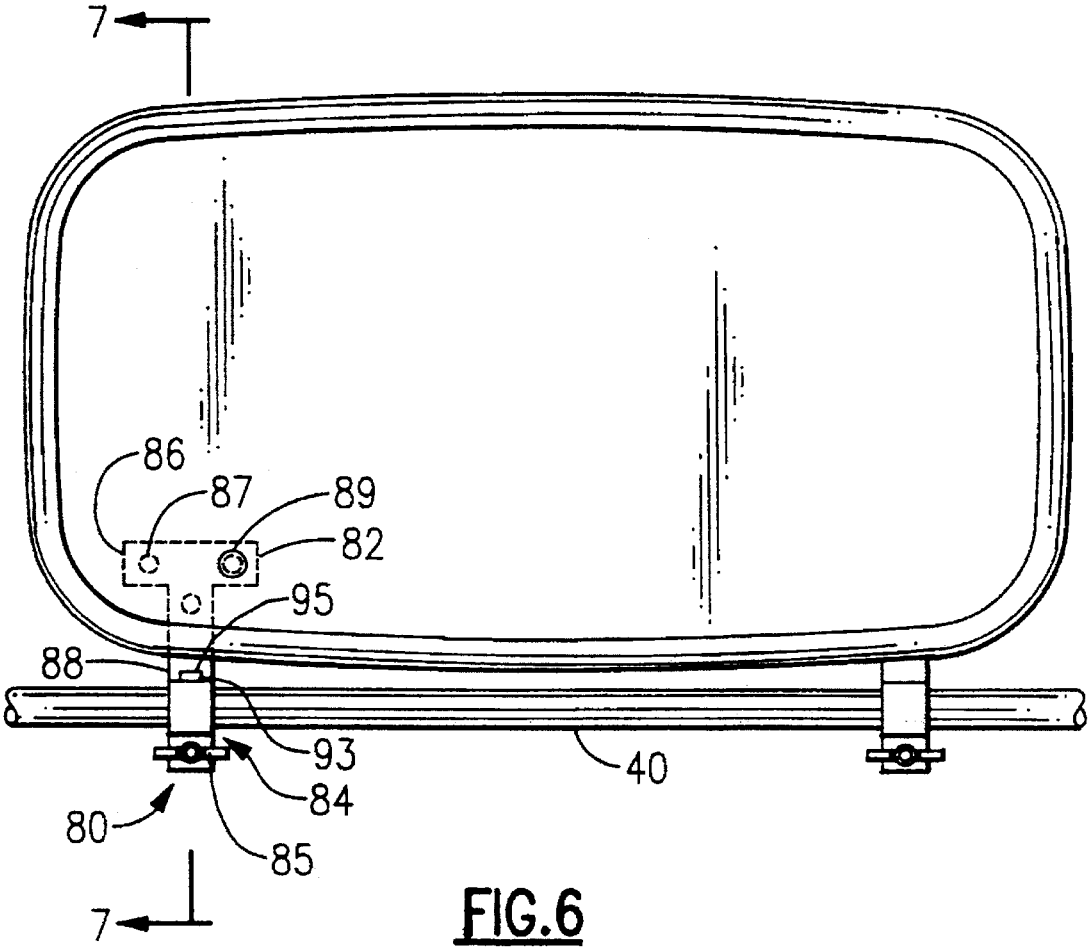
FIG. 6 is a top view of the catch tray shown in FIG. 5.
Figure 7:
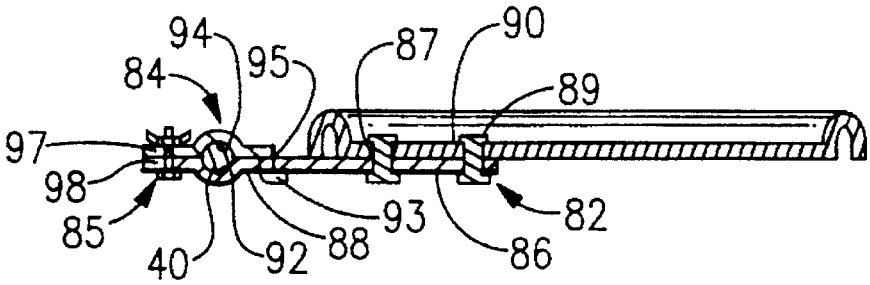
FIG. 7 is a cross-sectional side view of the catch tray shown in FIG. 5 taken along line 7—7.

Looking now at FIGS. 5–7 there is shown a child's high chair C with catch tray assemblies 50 supported by the support assembly 14 by attaching means 56 which comprises a pair of rung clamp assemblies 80. In a preferred embodiment of the present invention the rung clamp assemblies 80 comprises a T shaped support bracket 82, a clamping hasp 84 and a clamp screw 85. The support bracket 82 includes a tray engaging end 86, which defines a plurality of fastener apertures 87, and a rung engaging end 88. The tray engaging end 86 is generally planar and is attached to the underside of the planar tray body 52 by fasteners 89, such as rivets, disposed through the fasteners apertures 87 of the tray engaging end 61 and cooperating apertures 90 defined by the tray body 52.

The rung engaging end 88 of the support bracket 82 includes a curved clamp portion 92 which is adapted to engage a lower peripheral portion of a side rung 40. The clamping hasp 84 includes an engaging tang 93 and a curved hasp clamp portion 94 which is adapted to engage an upper peripheral portion of the side rung 40.

To secure the rung clamp assembly 80 to the upper side rung 40, the curved portion 92 of the rung engaging end 88 of the support bracket 82 is positioned about the rung 40. The tang 93 of the clamping hasp 84 is inserted into a tang engaging aperture 95 defined by the support bracket 82 adjacent the curved portion 92. The clamping hasp 84 is pivoted about the tang 93 such that the curved hasp portion 94 engages the upper peripheral surface of the side rung 40. The clamp screw 85 is disposed through cooperating clamping apertures, 97 and 98, defined in the support bracket 82 and the clamping hasp 84, respectively, adjacent the curved portions 92 and 94, respectively.

After the rung clamp assemblies 80 of the catch tray assemblies 10 are engaged with the rung 40, the catch tray 50 is preferably positioned with the upper tray catch surface 55 disposed in a substantially horizontal plane. The clamp screws 96 are then tightened to maintain that position.

Figure 8:
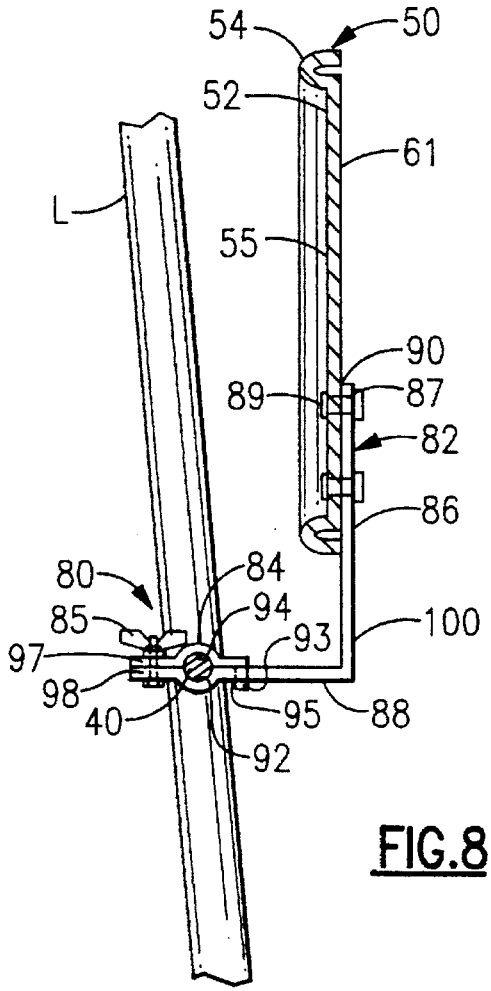
FIG. 8 is a side view of an alternative attaching means, shown in crossection, adapted to the catch tray shown in FIG. 5.

In the preferred embodiment of the present invention it would be desirable to allow the catch tray 50 to be oriented generally vertically for convenient storage of the high chair C. As shown in FIG. 8 the rung clamp assembly 80 includes an angled offset portion 100 which allows the catch tray 50 to be oriented in the vertical position without interfering with the legs of the high chair C. To move the catch tray 50 from the horizontal to the vertical position, the clamp screws 96 of each of the rung clamp assemblies 80 are loosened so that the rung clamp assembly 80 will rotate about the rung 40. The catch tray 50 is rotated about the rung 40 and then the clamp screws 69 are tightened to secure the catch tray 50 in the vertical orientation.

While the present invention in its various aspects has been described in detail with regard to preferred embodiments thereof, it should be understood that variations, modifications and enhancements can be made to the disclosed apparatus and procedures without departing from the spirit and scope of the present invention as defined in the appended claims.

What is claimed is:

1. A catch attachment for use with a high chair having seating structure supported above a support surface by a support structure, said seating structure comprising a seat and a back and said support structure comprising a plurality of elongate legs having one end engaged with said seating structure and opposed ends disposed in supported engagement with said support surface, the catch attachment for catching food and other articles dropped by a child occupying the high chair, and comprising:

a catch tray defining an upwardly facing catch surface;

a spring clamp assembly capable of supported engagement with said support structure of the high chair and selectively engagable with said high chair legs so that said catch tray is supported at a desired height above said support surface, the spring clamp assembly capable of compressively engaging said high chair legs to support said catch tray above said support surface said spring clamp assembly comprising opposed arcuate spring clamp members having a first end and a free end, said first ends of each of said spring clamp members being disposed in rigid engagement with one another, and said free ends capable of movement relative to each other, said first ends of said spring clamp members being disposed in supportive engagement with said catch tray, each of said spring clamp members defining an arcuate central portion that cooperate to form a central leg clamping region therebetween, said spring clamp members being capable of compressively engaging the leg of the high chair when the leg is disposed within said central leg clamping region, such that said spring clamp assembly is capable of supporting and maintaining said catch attachment in engagement with the legs of said high chair when said spring clamp members compressively engage said legs of said high chair;

a T-slot assembly extending along the length of said catch tray and defining a T-slot; and a slider plate capable of being captively yet slidingly engaged with said T-slot assembly and adapted to traverse said T-slot, said slider plate disposed in engagement with said first ends of said spring clamp members to support said spring clamp assembly in adjustable and sliding engagement with said catch tray.

2. The apparatus of claim 1, wherein said slider plate and said first ends of said spring clamp members are adjustably and pivotally engaged and wherein said spring clamp assembly further includes a pivot clamp screw to maintain a desired pivot orientation of the slider plate and said spring clamp members to maintain a desired orientation of said catch surface of said catch tray relative to the support surface.

3. The catch attachment of claim 1, wherein said catch tray includes a generally rectangular planar tray body having a peripheral perimeter edge having an upturned lip extending peripherally about said planar tray body adjacent said perimeter edge.

4. The catch attachment of claim 1, wherein said catch tray is supportable at a height for keeping objects falling on and supported by said catch surface out of reach of a child occupying said high chair.

5. A high chair used for seating a child while the child is eating, said high chair comprising:

a seating structure supported above a support surface by a support structure, said seating structure comprising a seat and a back and said support structure comprising a plurality of elongate legs having one end engaged with said seating structure and opposed ends disposed in supported engagement With said support surface; and, a catch attachment comprising:

a catch tray defining an upwardly facing catch surface, a spring clamp assembly disposed in supported engagement with said support structure of the high chair and selectively engaged with said high chair legs so that said catch tray is supported at a desired height above said support surface, the spring clamp assembly capable of compressively engaging said high chair legs to support said catch tray above said support surface;

opposed arcuate spring clamp members having a first end and a free end, said first ends of each of said spring clamp members being disposed in rigid engagement with one another, and said free ends capable of movement relative to each other, said first ends of said spring clamp members being disposed in supportive engagement with said catch tray, each of said spring clamp members defining an arcuate central portion that cooperate to form a central leg clamping region therebetween, said spring clamp members being capable of compressively engaging the leg of the high chair when the leg is disposed within said central leg clamping region, such that said spring clamp assembly supports and maintains said catch attachment in engagement with the legs of said high chair when said spring clamp members compressively engage said legs of said high chair;

a T-slot assembly extending along the length of said catch tray and defining a T-slot; and a slider plate captively yet slidingly engaged with said T-slot assembly and adapted to traverse said T-slot, said slider plate disposed in engagement with said first ends of said spring clamp members to support said spring clamp assembly in adjustable and sliding engagement with said catch tray.

6. The apparatus of claim 5, wherein said slider plate and said first ends of said spring clamp members are adjustably and pivotally engaged and wherein said spring clamp assembly further includes a pivot clamp screw to maintain a desired pivot orientation of the slider plate and said spring clamp members to maintain a desired orientation of said catch surface of said catch tray relative to the support surface.

* * * * *